US006812813B2

(12) United States Patent
Mizoguchi et al.

(10) Patent No.: US 6,812,813 B2
(45) Date of Patent: Nov. 2, 2004

(54) METHOD FOR ADJUSTING FREQUENCY OF ATTENUATION POLE OF DUAL-MODE BAND PASS FILTER

(75) Inventors: Naoki Mizoguchi, Shiga-ken (JP); Seiji Kanba, Kusatsu (JP); Hisatake Okamura, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/805,648

(22) Filed: Mar. 14, 2001

(65) Prior Publication Data

US 2001/0024151 A1 Sep. 27, 2001

(30) Foreign Application Priority Data

Mar. 13, 2000 (JP) ..... 2000-068795

(51) Int. Cl.[7] ..... H01P 1/203
(52) U.S. Cl. ..... 333/204; 333/235; 333/205
(58) Field of Search ..... 333/204, 219, 333/205, 235

(56) References Cited

U.S. PATENT DOCUMENTS

| | | | | |
|---|---|---|---|---|
| 3,639,857 A | * | 2/1972 | Okoshi et al. | 331/107 R |
| 3,778,717 A | * | 12/1973 | Okoshi et al. | 455/129 |
| 5,703,546 A | * | 12/1997 | Takahashi et al. | 333/204 |
| 6,239,674 B1 | * | 5/2001 | Enokihara et al. | 333/204 |

FOREIGN PATENT DOCUMENTS

| | | |
|---|---|---|
| EP | 0 509 636 A1 | 10/1992 |
| JP | 51-018454 | 2/1976 |
| JP | 3-009502 | 1/1991 |
| JP | 5-251904 | 9/1993 |
| JP | 09-139612 | 5/1995 |
| JP | 8-046413 | 2/1996 |
| JP | 09-162610 | 6/1997 |
| JP | 10-173405 A | 6/1998 |

OTHER PUBLICATIONS

"Two–Stage Bandpass Filters Based on Rotated Excitation of Circular Dual–Mode Resonators"; Ikuo AWAI et al.; IEEE Microwave and Guided Letters, IEEE Inc, New York, US, vol. 7, No. 8, Aug. 1, 1997; pp. 212–213. XP000658622; ISSN: 1051–8207.

"General Theory of a Circular Dual–Mode Resonator and Filter"; Ikuo Awai; IEICE Transactions on Electronics, Institute of Electronics Information and Comm. Eng. Tokyo, JP, vol. E81–C, No. 11, Nov. 1998; pp. 1757–1763; XP000875148; ISSN: 0916–8524.

"New Planar Dual–Mode Filter Using Cross–Slotted Patch Resonator for Simultaneous Size and Loss Reduction"; Lei ZHU et al.; IEEE Transactions on Microwave Theory and Techniques, IEEE Inc. New York, US, vol. 47, No. 5; May 1999; pp. 650–654; XP000827467; ISSN: 0018–9480.

J. Hattori et al.: "Compact Filter Using Small Size Mode Dielectric Resonator for Mobile Communication Pico Base Station"; IEICE Electronic Society Convention; Japan; Aug. 13, 1997; C–2–54; p. 89.

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

A method for easily adjusting the frequency of an attenuation pole in a dual-mode band pass filter which is very compact and greatly increases coupling strength while maintaining a great deal of freedom of design. The dual-mode band pass filter includes a metal film partially disposed on a main surface of a dielectric substrate or disposed inside of the dielectric resonator so as to define a resonator. An opening is formed in the metal film to couple two resonance modes. Input/output coupling circuits are coupled to the metal film. At least one of coupling portions of the input/output coupling circuits or input/output portions thereof are moved in a direction along a perimeter of the metal film.

9 Claims, 11 Drawing Sheets

METHOD FOR ADJUSTING FREQUENCY OF ATTENUATION POLE OF DUAL-MODE BAND PASS FILTER

BACKGROUND OF THE INVENTION

1. Field of the Invention

The present invention relates to a dual-mode band pass filter for use as a band filter, for example, in a communication apparatus used in a range of a microwave band to a millimeter-wave band.

2. Description of the Related Art

Conventional band pass filters used for high frequency bands include various kinds of dual-mode band pass filters (Miniature Dual Mode Microstrip Filters, J. A. Curtis and S. J. Fiedziuszko, 1991 IEEE MTT-S Digest, etc.).

Each of FIGS. 12 and 13 is a schematic plan view for illustrating a conventional dual-mode band pass filter.

In a band pass filter 200 shown in FIG. 12, a circular conductive film 201 is provided on a dielectric substrate (not shown). The conductive film 201 is coupled to input/output coupling circuits 202 and 203 arranged at an angle of 90 degrees relative to each other. In addition, a top-end open stub 204 is arranged so as to define an angle of 45 degrees with respect to the part where the input/output coupling circuit 203 is arranged. With this arrangement, since two resonance modes having different resonant frequencies are coupled to each other, the band pass filter 200 acts as a dual-mode band pass filter.

In addition, in a dual-mode band pass filter 210 shown in FIG. 13, a substantially square conductive film 211 is provided on a dielectric substrate. The conductive film 211 is coupled to input/output coupling circuits 212 and 213 disposed at an angle of 90 degree. Furthermore, a corner positioned at an angle of 135 degrees with respect to the input/output coupling circuit 213 is cut away to form a cut-away part 211*a*. With this arrangement, the resonant frequencies of two resonance modes are made different. As a result, since the two resonance modes are coupled to each other, the band pass filter 210 acts as a dual-mode band pass filter.

On the other hand, as an alternative to the circular conductive film 201 shown in FIG. 12, there is provided a dual-mode filter using a loop-shaped conductive film. That is, in each of Japanese Unexamined Patent Application Publication No. 9-139612 and Japanese Unexamined Patent Application Publication No. 9-162610, there is a dual-mode filter. This dual-mode filter incorporates a loop-shaped ring transmission line. In addition, as in the case of the dual-mode band pass filter shown in FIG. 12, input/output coupling circuits are arranged at a central angle of 90 degrees therebetween, and a top-end open stub is disposed at a part of the ring transmission line.

In the conventional dual-mode band pass filter shown in each of FIGS. 12 and 13, a two-stage band pass filter resonating at the two different resonant frequencies is provided. As a result, a miniaturized band pass filter can be obtained.

In each of the dual-mode band pass filters described above, however, the circular or square conductive film pattern has a structure that couples the input/output coupling circuits at each of the above specified angles, the coupling strength between the two resonance modes cannot be increased. Thus, there is a problem in that the pass band for the filter cannot be broadened.

In the band pass filter shown in FIG. 12, the conductive film 201 is circular. In the band pass filter shown in FIG. 13, the conductive film 211 is substantially square. That is, both conductive films 201 and 211 have limited configurations. As a result, in each of the above-described band pass filter, since the frequency band is determined by the dimensions of the circular or square conductive film, particularly, the position of an attenuation pole (the frequency) cannot be easily adjusted.

SUMMARY OF THE INVENTION

In order to overcome the problems described above, preferred embodiments of the present invention provide a method for adjusting the frequency of an attenuation pole of a dual-mode band pass filter. With this band pass filter, the above-described problems of the conventional art can be solved, and the size of the filter can be greatly reduced. In addition, the coupling strength between two resonance modes can be greatly increased. Furthermore, the dual-mode band pass filter of preferred embodiments of the present invention has a great deal of the freedom of design.

According to a first preferred embodiment of the present invention, a method for adjusting the frequency of an attenuation pole of a dual-mode band pass filter includes the steps of forming a metal film on a surface of a dielectric substrate or within the dielectric substrate, arranging a ground electrode such that the ground electrode overlaps with the metal film via at least a part of the dielectric substrate in a thickness direction of the dielectric substrate, forming at least one opening in the metal film to couple two resonance modes, coupling an input/output coupling circuit to the metal film, forming a coupling portion capacitively coupled to a perimeter of the metal film via a gap, and forming an input/output portion coupled to the coupling portion, and the input/output coupling circuit includes the coupling portion and the input/output portion. In this method, at least one of the coupling portion and the input/output portion is moved in a direction along the perimeter of the metal film.

According to a second preferred embodiment of the present invention, a method for adjusting the frequency of an attenuation pole of a dual-mode band pass filter includes the steps of forming a metal film on a surface of a dielectric substrate or within the dielectric substrate, arranging a ground electrode such that the ground electrode overlaps with the metal film via at least a part of the dielectric substrate in a thickness direction of the dielectric substrate, forming at least one opening in the metal film to couple two resonance modes, and forming an input/output coupling circuit coupled to the metal film. In this method, the input/output coupling circuit is defined by one of a strip line and a microstrip line. One end of the strip line or the microstrip line is directly and electrically connected to the metal film. A point for coupling the strip line or the microstrip line to the metal film is moved on the perimeter of the metal film.

According to a third preferred embodiment of the invention, a method for adjusting the frequency of an attenuation pole of a dual-mode band pass filter includes the steps of forming a metal film on a surface of a dielectric substrate or within the dielectric substrate, arranging a ground electrode such that the ground electrode overlaps with the metal film via at least a part of the dielectric substrate in a thickness direction of the dielectric substrate, forming at least one opening in the metal film to couple two resonance modes, and forming an input/output coupling circuit coupled to the metal film. In this method, the metal film and the input/output coupling circuit are located on different layers of the dielectric substrate. The input/output coupling circuit overlaps with the metal film via the dielectric layer so that the input/output coupling circuit is capacitively coupled to the metal film. A point for coupling the input/output coupling circuit to the metal film is moved along the perimeter of the metal film on the dielectric layer.

According to a fourth preferred embodiment of the present invention, a method for adjusting the frequency of an attenuation pole of a dual-mode band pass filter includes the steps of forming a metal film on a surface of a dielectric substrate or within the dielectric substrate, arranging a ground electrode such that the ground electrode overlaps with the metal film via at least a part of the dielectric substrate in a thickness direction of the dielectric substrate, forming at least one opening in the metal film to couple two resonance modes, forming an input/output coupling circuit coupled to the metal film, and forming an insulating layer having a via-hole electrode between the input/output coupling circuit and the metal film. In this method, one end of the via-hole electrode is electrically connected to the input/output coupling circuit and the other end thereof is electrically connected to the metal film. Positions for connecting the via-hole electrode to the input/output coupling circuit and the metal film are moved along the perimeter of the metal film.

Other features, elements, characteristics and advantages of the present invention will become more apparent from the following detailed description of preferred embodiments thereof with reference to the attached drawings.

DETAILED DESCRIPTION OF PREFERRED EMBODIMENTS

The present invention will be described by illustrating the details of a method for adjusting the frequency of an attenuation pole of a dual-mode band pass filter according to various preferred embodiments of the present invention with reference to the drawings.

Figure 1:
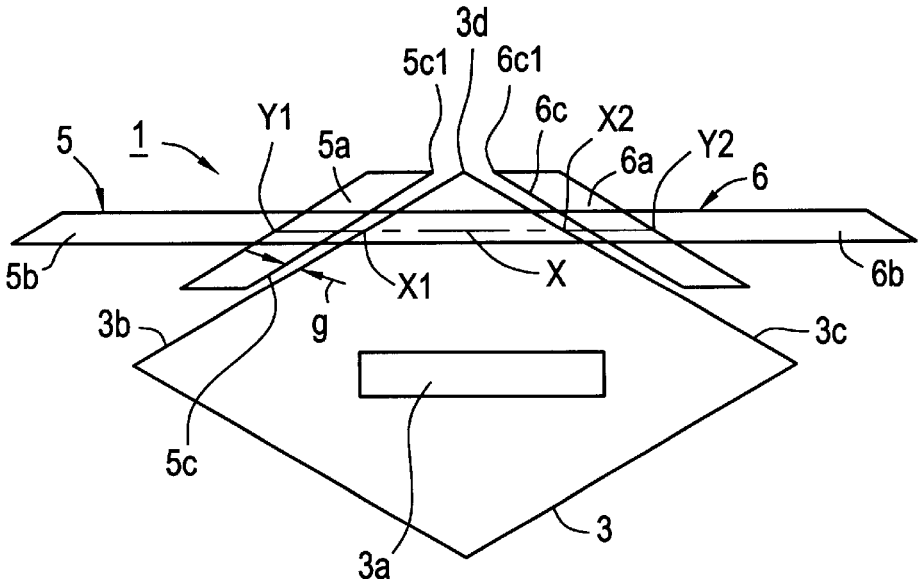
FIG. 1 is a schematic plan view for illustrating a method for adjusting the frequency of an attenuation pole of a dual-mode band pass filter according to a first preferred embodiment of the present invention.
Figure 2:
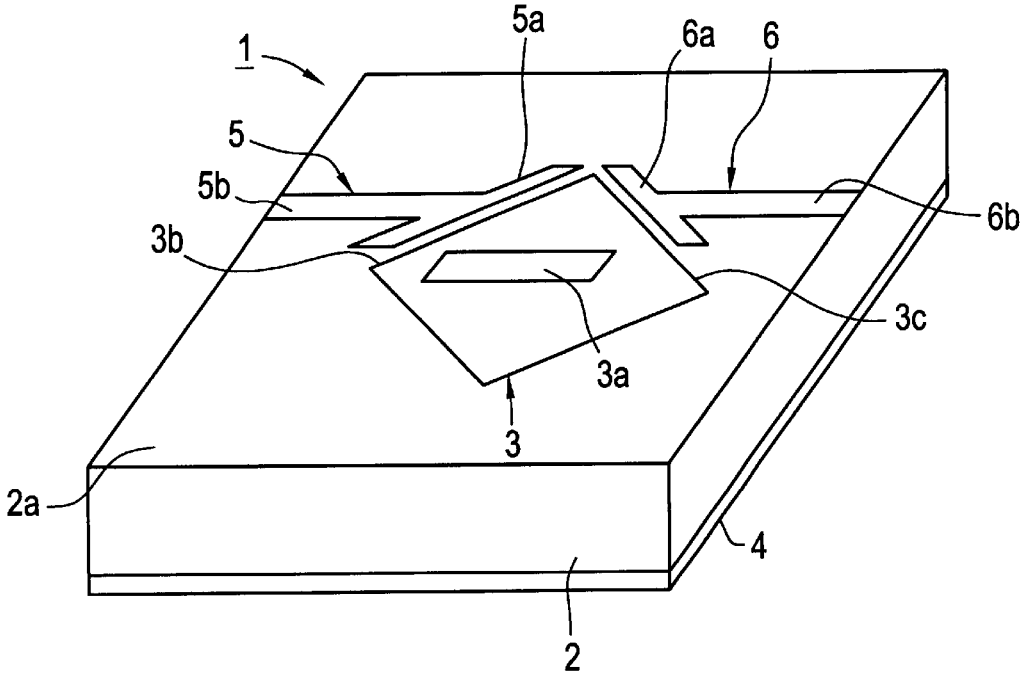
FIG. 2 is a perspective view of the dual-mode band pass filter according to the first preferred embodiment of the present invention.

FIG. 1 is a schematic plan view for illustrating a method for adjusting the frequency of an attenuation pole of a dual-mode band pass filter according to a first preferred embodiment of the present invention. FIG. 2 is a perspective view thereof.

A dual-mode band pass filter 1 has a dielectric substrate 2 having a substantially rectangular plate configuration. In this preferred embodiment, the dielectric substrate 2 is preferably made of a fluoro resin having a permeability $\epsilon r$ of about 2.58. However, in this preferred embodiment and other preferred embodiments of the present invention, the dielectric material used to form a dielectric substrate is not limited to the fluoro resin. For example, a dielectric material such as $BaO—Al_2O_3—SiO_2$ ceramic can be used as an appropriate material.

The thickness of the dielectric substrate 2 is not specifically determined. In this preferred embodiment, the thickness thereof is about 350 $\mu$m.

A metal film 3 for forming a resonator is preferably disposed on an upper surface 2*a* of the dielectric substrate 2. The metal film 3 is partially disposed on the dielectric substrate 2. The metal film 3 preferably has a rhombic shape. In addition, an opening 3*a* is formed in the metal film 3. The opening 3*a* has a substantially rectangular-planar shape, having a lengthwise direction that is substantially parallel to the direction of a longer diagonal line of the metal film 3.

In this preferred embodiment, each sideline of the rhombic shape of the metal film 3 is preferably about 15 mm in length, the longer diagonal line thereof is preferably about 24 mm in length, and the shorter diagonal line thereof is preferably about 18 mm in length. The longer sideline of the opening 3*a* is about 9 mm in length and the shorter sideline thereof is about 0.2 mm in length. The opening 3*a* is formed in such a manner that the center of the opening 3*a* coincides with the center of the metal film 3. The dimensions of the metal film 3 and opening 3*a*, and the position of the opening 3*a* are not restricted to the specific details described above, and can be appropriately changed according to a desirable central frequency and a desirable bandwidth when necessary.

A ground electrode 4 is disposed on the entire lower surface of the dielectric substrate 2.

On the metal film 3, each of input/output coupling circuits 5 and 6 is separated by a predetermined gap from each of a pair of sidelines 3*b* and 3*c* having a large interior angle therebetween. The input/output coupling circuits 5 and 6 are arranged by disposing metal films made of the same material as that of the metal film 3 on the dielectric substrate 2. The input/output coupling circuit 5 has a coupling portion 5*a* and an input/output portion 5*b*, and the input/output coupling circuit 6 has a coupling portion 6*a* and an input/output portion 6*b*. The coupling portions 5*a* and 6*a* have parallelogrammic shapes in FIG. 1. However, other appropriate shapes can also be applied if only the coupling portion 5*a* has an edge 5*c* that is substantially parallel to the sideline 3*b* of the metal film 3 and the coupling portion 6*a* has an edge 6*c* that is substantially parallel to the sideline 3*c* thereof. The sideline 5*c* of the coupling portion 5*a* faces the sideline 3*b* of the metal film 3 and the sideline 6*c* of the coupling portion 6*a* faces the sideline 3*c* thereof via predetermined gaps g, respectively. With this arrangement, the coupling portions 5*a* and 6*a* are capacitively coupled to the metal film 3.

The input/output portion 5*b* is coupled to the coupling portion 5*a* and the input/output portion 6*b* is coupled to the coupling portion 6*a*, and the input/output portions 5*b* and 6*b* are electrically connected to external circuits.

In this preferred embodiment, for example, an input voltage is applied between the input/output coupling circuit 5 and the ground electrode 4, with the result that an output voltage is extracted between the input/output coupling circuit 6 and the ground electrode 4. In this case, since the metal film 3 is rhombic and the opening 3*a* is formed therein, two occurring resonance modes are coupled with each other so that the filter of the first preferred embodiment of the present invention functions as a dual-mode band pass filter.

In other words, in the dual-mode band pass filter 1, there are obtained the resonance mode occurring in the direction of a virtual straight line connecting the center of the coupling portion 5*a* of the input/output coupling circuit 5 and the center of the coupling portion 6*a* of the input/output coupling circuit 6 and the resonance mode occurring in a direction that is substantially perpendicular to the virtual straight line. The resonance current in the direction that is substantially perpendicular to the virtual straight line is stopped by the opening 3*a*. Then, with an inductance loading effect, the resonant frequency in the direction that is substantially perpendicular to the virtual straight line moves to the low-frequency side. The size of the opening 3*a* is adjusted so that the amount of a movement to the low-frequency side is controlled. As a result, the two resonance modes can be coupled with each other.

Figure 3:
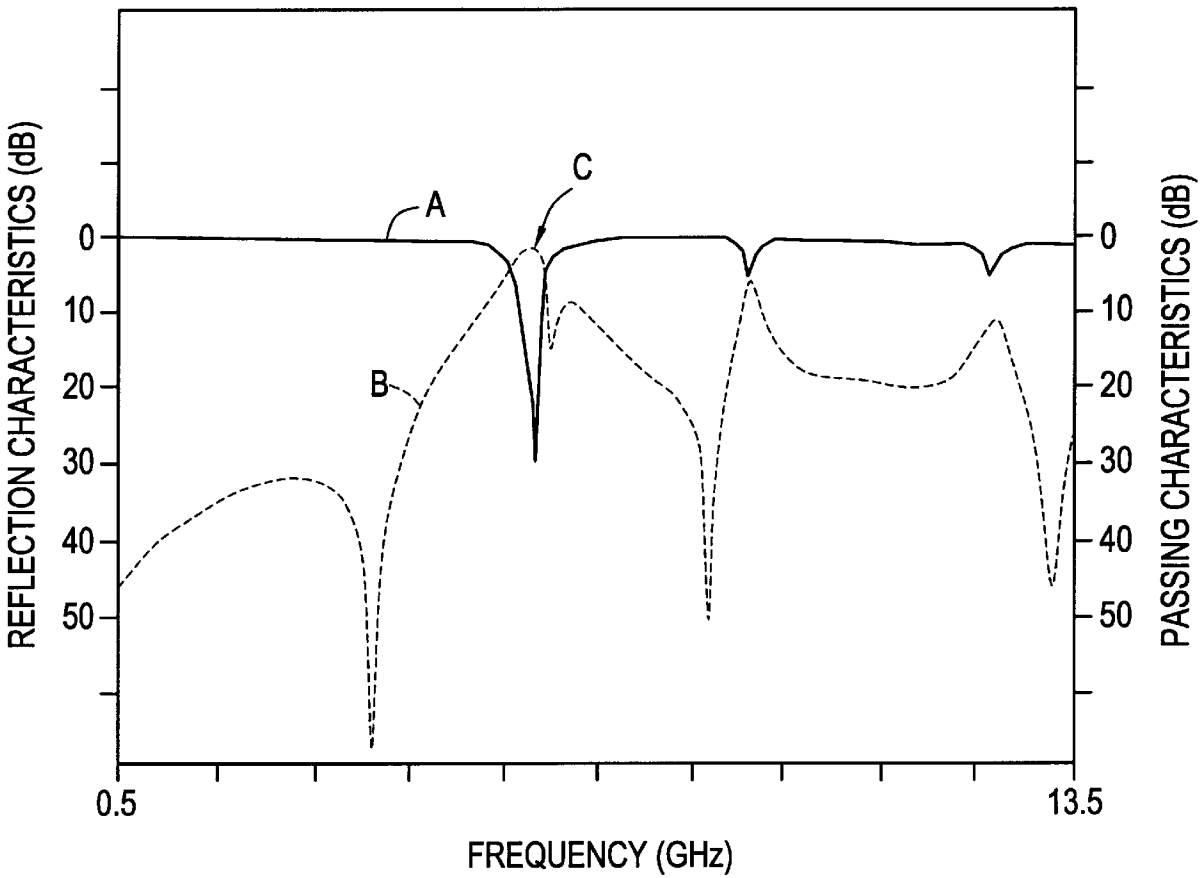
FIG. 3 is a graph showing the frequency characteristics of the dual-mode band pass filter according to the first preferred embodiment of the present invention.

FIG. 3 shows an example of the frequency characteristics of the band pass filter according to the present preferred embodiment. In FIG. 3, a solid line A indicates reflection characteristics, and a broken line B indicates passing characteristics. In addition, regarding the frequency characteristics of dual-mode band pass filters shown in FIG. 4 and the other figures, similarly, the reflection characteristics are indicated by solid lines A and the passing characteristics are indicated by broken lines B.

As shown in FIG. 3, there is a band pass filter in which a band indicated by an arrow C is the pass band. That is, in the dual-mode band pass filter 1 of the present preferred embodiment, by forming the opening 3*a* in the metal film 3, the two resonance modes are coupled with each other so that the frequency characteristics for functioning as the dual-mode band pass filter can be obtained.

In the method for adjusting the frequency of an attenuation pole according to the present preferred embodiment, in the above dual-mode band pass filter 1, the attenuation-pole frequency is adjusted by moving the positions where the input/output portion 5*b* is coupled to the coupling portion 5*a* and the input/output portion 6*b* is coupled to the coupling portion 6*a*, along the sidelines 3*b* and 3*c* of the metal film 3, respectively. This will be illustrated with reference to FIGS. 4 and 5.

Figure 4:
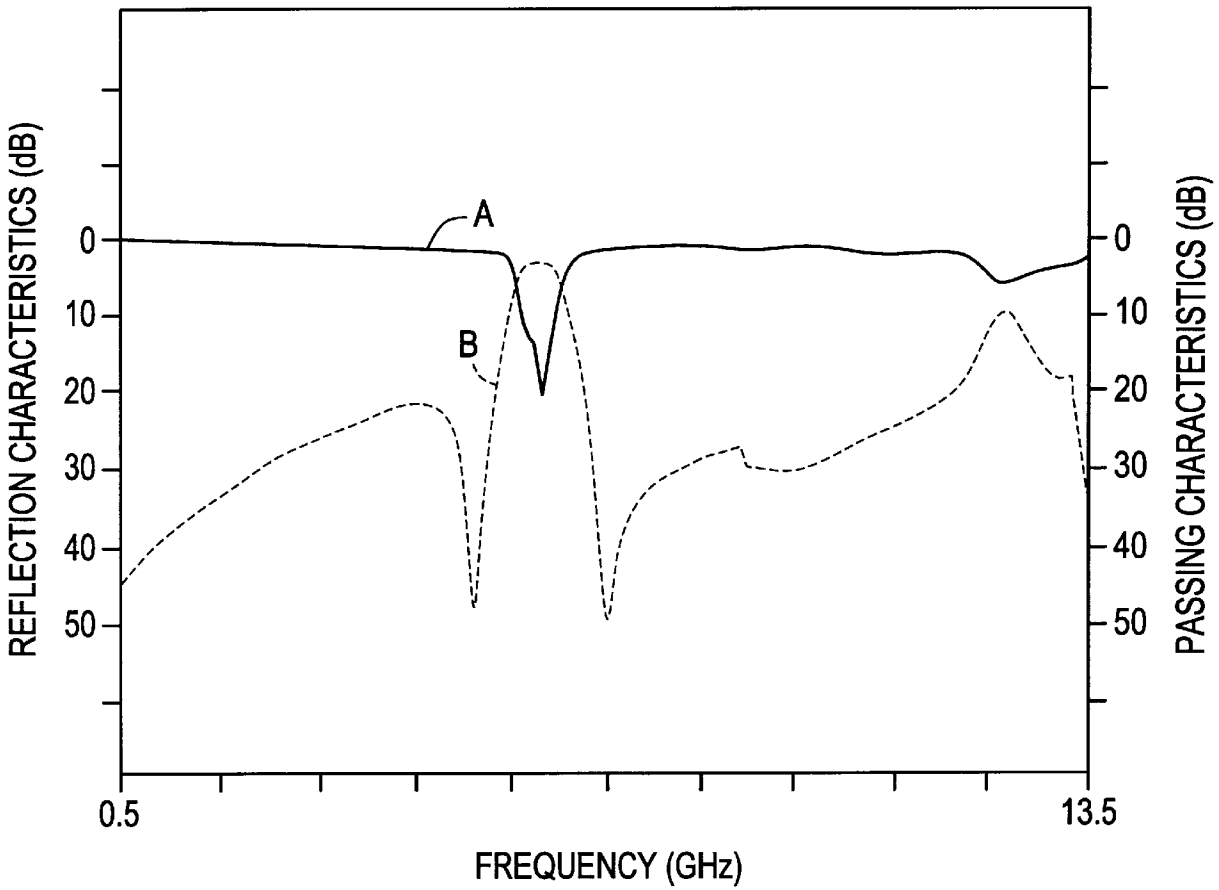
FIG. 4 is a graph showing the frequency characteristics of the dual-mode band pass filter according to the first preferred embodiment obtained when the positions of input/output portions are deviated.
Figure 5:
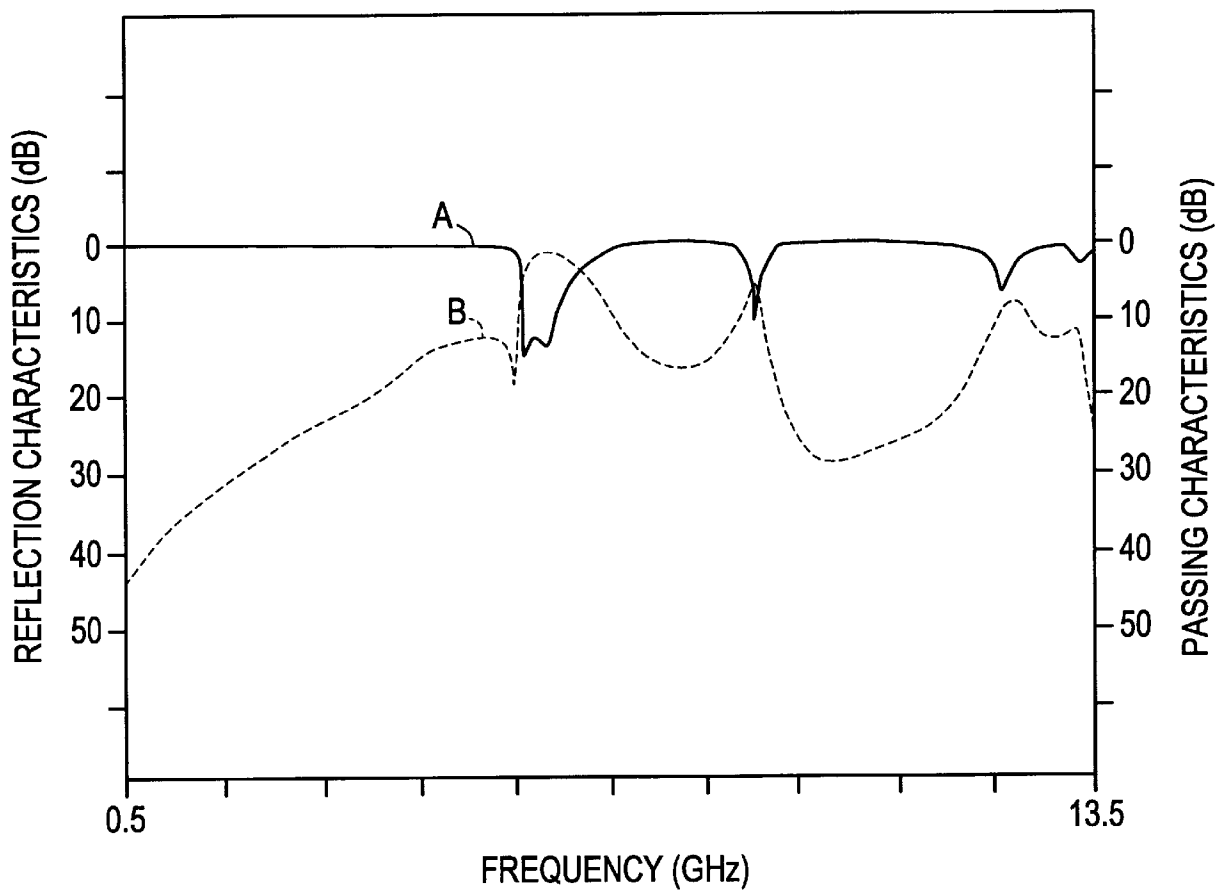
FIG. 5 is a graph showing the frequency characteristics of the dual-mode band pass filter according to the first preferred embodiment obtained when the positions of points coupling the input/output portions to coupling portions even more are deviated.

In the dual-mode band pass filter having the frequency characteristics shown in FIGS. 3 to 5, the coupling portions 5*a* and 6*a* are preferably formed in the same manner. Specifically, the coupling portion 5*a* has the edge 5*c* and the coupling portion 6*a* has the edge 6*c*, and each of the edges 5*c* and 6*c* is separated from each of the sidelines 3*b*and 3*c* by a gap g of, for example, approximately 0.1 mm in length. Each of the edges 5*c* and 6*c* is, for example, about 13 mm in length in parallel to each of the sidelines 3*b* and 3*c* from each of ends $5c_1$ and $6c_1$ separated by the gap g from a top 3*d*. In addition, a coupling point $Y_1$ of the input/output portion 5*b* and the coupling portion 5*a* and a coupling point $Y_2$ of the input/output portion 6*b* and the coupling portion 6*a* are determined in such a manner that each of positions $X_1$ and $X_2$ where the virtual straight line X connecting the input/output portions 5*b* and 6*b* crosses the sidelines 3*b* and 3*c* is preferably, for example, about 5 mm from the top 3*d*.

Regarding the frequency characteristics shown in FIGS. 4 and 5, the coupling point of the input/output portion 5*b* and the coupling portion 5*a* and the coupling point of the input/output portion 6*b* and the coupling portion 6*a* are determined in such a manner that the virtual lines are in positions at distances of about 7 mm and about 9 mm from the top 3*d* along the sidelines 3*b* and 3*c*.

As clearly found in a comparison among FIGS. 3 to 5, when the positions of the input/output portions 5*b* and 6*b* are deviated as described above, more specifically, even in a case in which the coupling point of the coupling portion 5*a* and the input/output portion 5*b* and the coupling point of the coupling portion 6*a* and the input/output portion 6*b* are moved in the directions of the sidelines 3*b* and 3*c* of the rhombic metal film 3, the filter 1 can act as a dual-mode band pass filter. Additionally, it was discovered that the attenuation-pole frequency can be changed by moving the positions of the coupling points.

That is, in the method according to the present preferred embodiment, as described above, the adjustment of the attenuation-pole frequency of the dual-mode band pass filter 1 can be performed by changing the positions of the coupling point of the input/output portion 5*b* and the coupling portion 5*a* and the coupling point of the input/output portion 6*b* and the coupling portion 6*a*.

Thus, first, the rhombic metal film 3 having the same size is formed on the dielectric substrate and the opening 3*a* is formed in the dielectric substrate. Then, the coupling portions 5*a* and 6*a* and the input/output portions 5*b* and 6*b* are arranged such that the position of the coupling point $Y_1$ of the coupling portion 5a and the input/output portion 5*b* and the position of the coupling point $Y_2$ of the coupling portion 6*a* and the input/output portion 6*b* are deviated from the previous positions. With this arrangement, clearly, the dual-mode band pass filter 1 can have a desirable attenuation-pole frequency. As a result, the present preferred embodiment can facilitate the adjustment of the attenuation-pole frequency of the dual-mode band pass filter.

Figure 6:
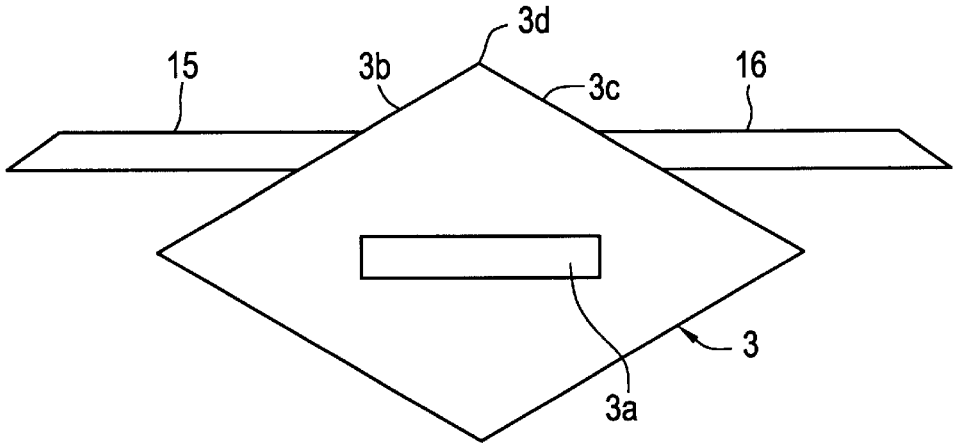
FIG. 6 is a schematic plan view for illustrating a method for adjusting the frequency of an attenuation pole of a dual-mode band pass filter according to a second preferred embodiment of the present invention.

FIG. 6 is a schematic plan view for illustrating a method for adjusting the frequency of an attenuation pole of a dual-mode band pass filter according to a second preferred embodiment of the present invention. FIG. 6 shows only a metal film and input/output coupling circuits disposed on a dielectric substrate (not shown), in the dual-mode band pass filter. This is equivalent to FIG. 1 shown in the first preferred embodiment of the present invention.

The dielectric substrate and a ground electrode disposed on a lower surface of the dielectric substrate are preferably formed in the same manner as those of the dual-mode band pass filter 1 according to the first preferred embodiment of the present invention. Thus, the explanation thereof in the first preferred embodiment is also applicable to the second preferred embodiment of the present invention.

In the second preferred embodiment of the present invention, the metal film 3 and the opening 3*a* are arranged in the same manner as those used in the first preferred embodiment of the present invention. However, unlike the first preferred embodiment, the input/output coupling circuits of the second preferred embodiment are defined by strip lines 15 and 16 directly and electrically connected to the sidelines 3*b* and 3*c* of the metal film 3.

Figure 7:
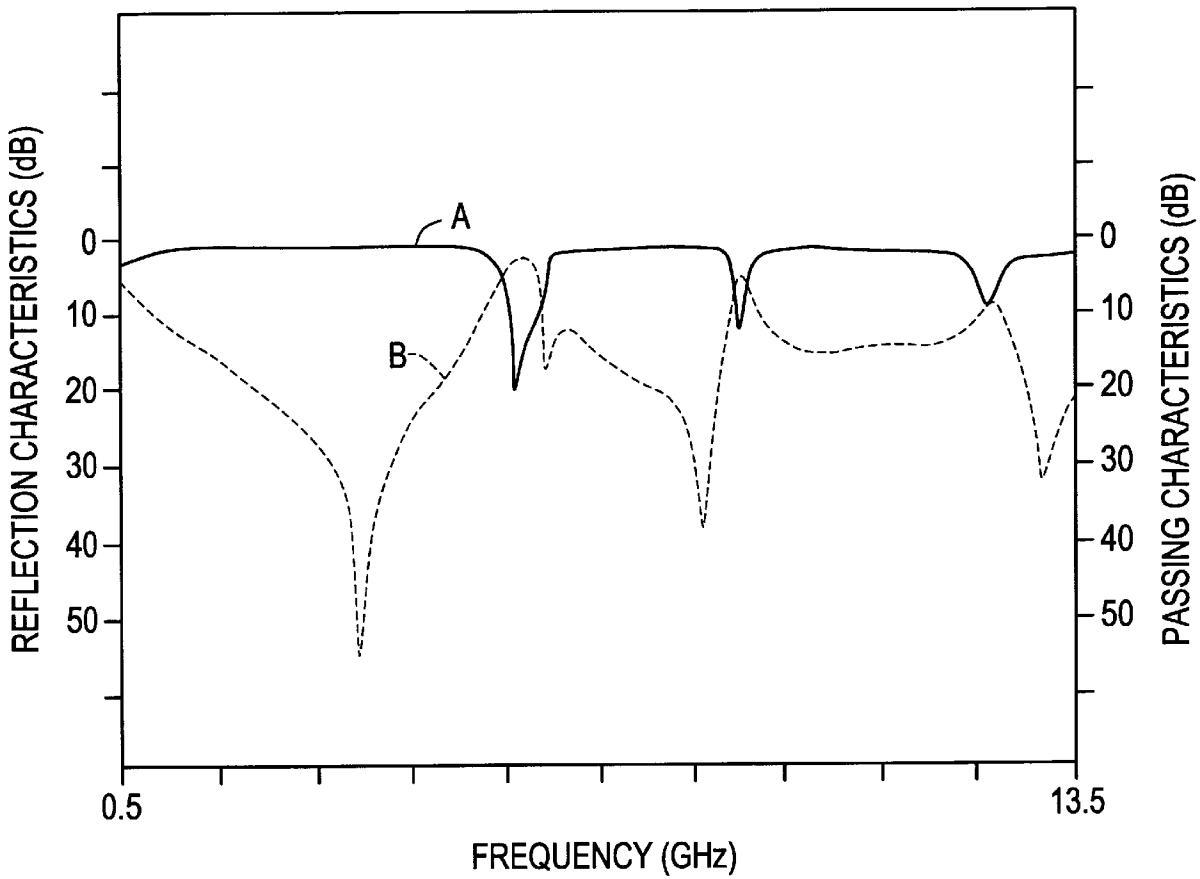
FIG. 7 is a graph showing the frequency characteristics of the dual-mode band pass filter according to the second preferred embodiment of the present invention.
Figure 8:
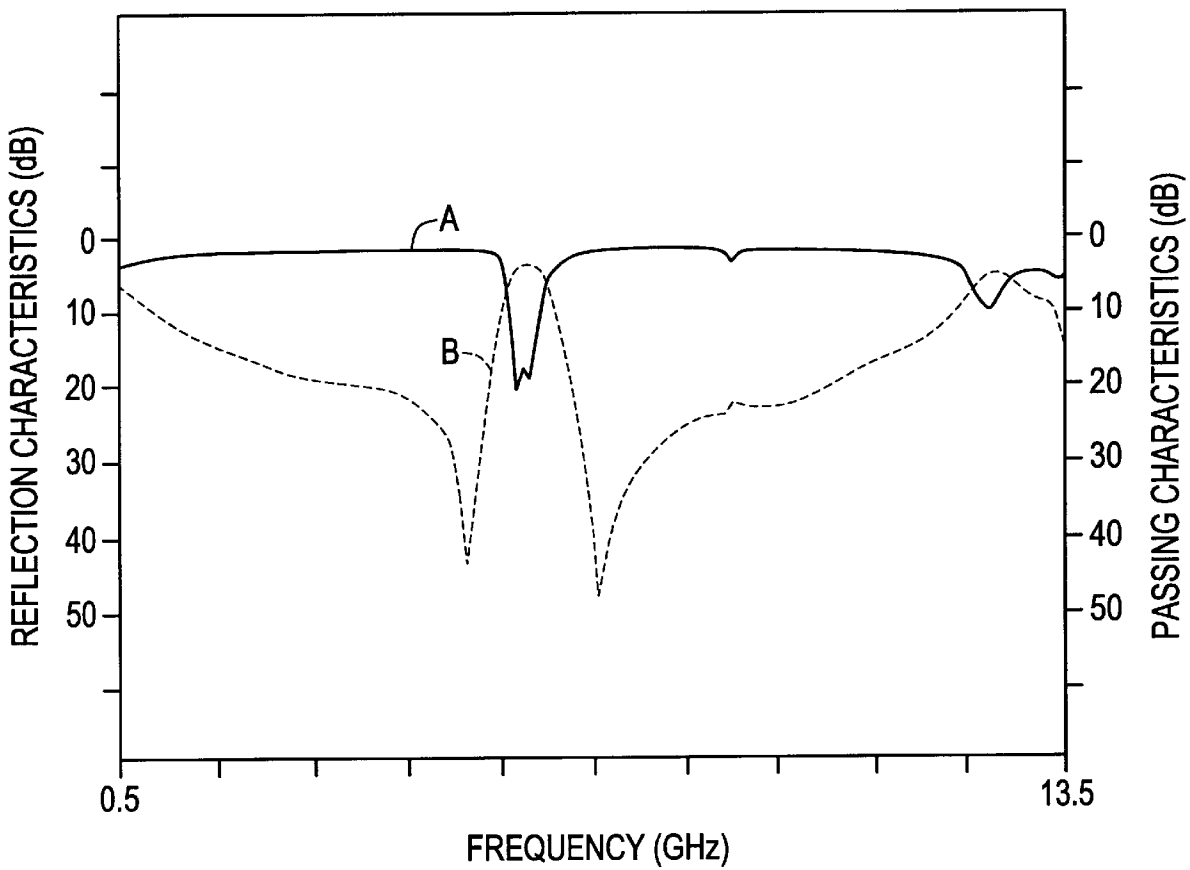
FIG. 8 is a graph showing the frequency characteristics of the dual-mode band pass filter according to the second preferred embodiment obtained when the positions of input/output portions are deviated.
Figure 9:
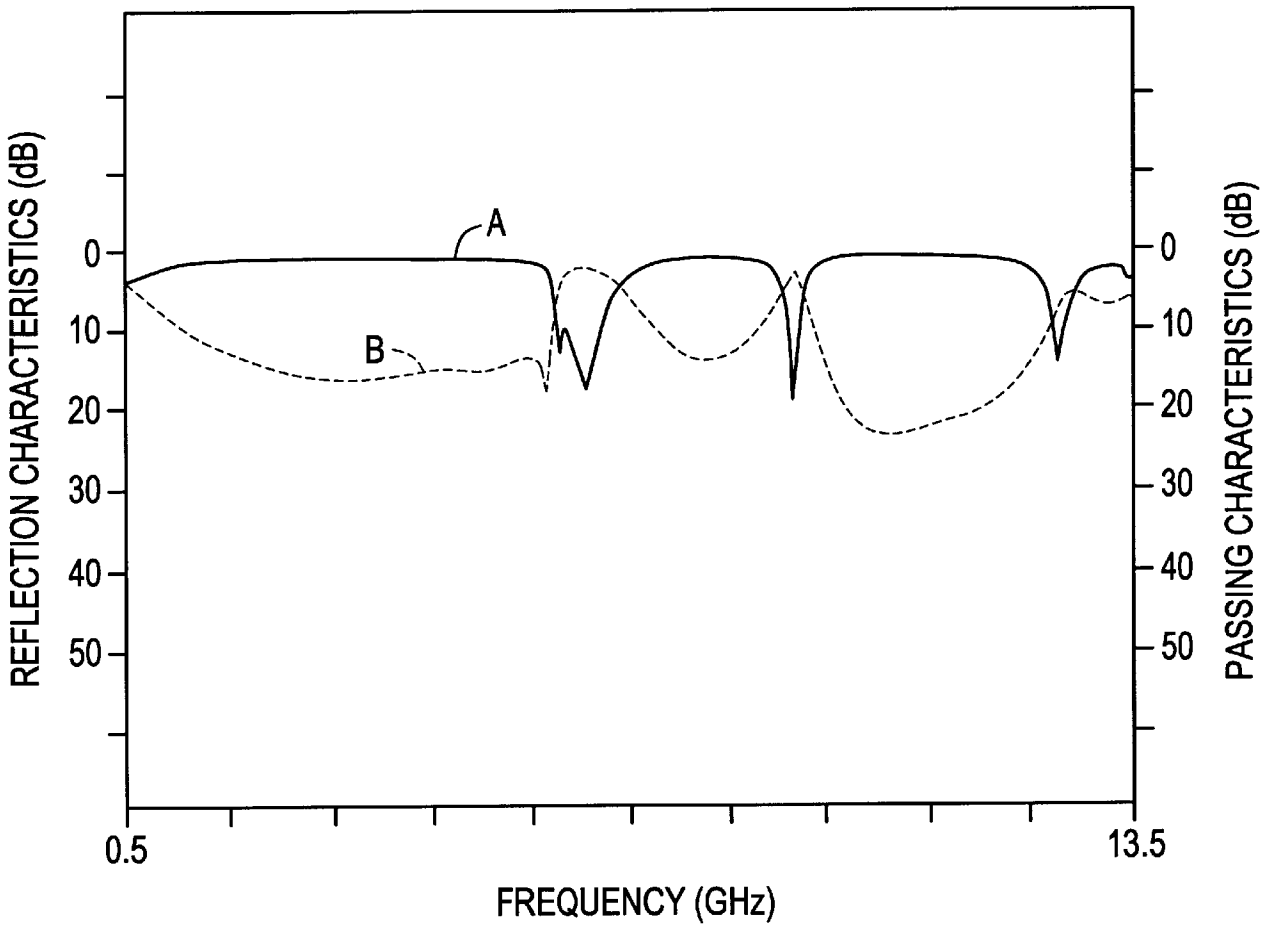
FIG. 9 is a graph showing the frequency characteristics of the dual-mode band pass filter according to the second preferred embodiment obtained when the positions of points coupling the input/output portions to coupling portions are more deviated.

The dielectric substrate, the metal film 3, and the opening 3*a* are preferably made of the same material in the same dimensions as the material and dimensions used in the first preferred embodiment of the present invention. Next, points connecting the strip lines 15 and 16 to the sidelines 3*b* and 3*c* of the metal film 3, that is, coupling points are preferably located at distances of about 5 mm, about 7 mm, and about 9 mm from the top 3*d* to constitute three kinds of dual-mode band pass filters 1. FIGS. 7 to 9 show the frequency characteristics of these dual-mode band pass filters.

As shown in FIGS. 7 to 9, when the strip lines 15 and 16 as the input/output coupling circuits are directly connected to the sidelines 3*b* and 3*c* of the metal film 3 to couple, it is found that each filter can also function as a dual-mode band pass filter. In addition, when the positions of the coupling points of the strip lines 15 and 16 and the metal film 3 are moved along the sidelines 3*b* and 3*c*, it is also found that the attenuation-pole frequency can be changed, thereby facilitating the adjustment of the attenuation-pole frequency. As an alternative to the strip-line structure, the present preferred embodiment can also be applied to a microstrip line structure.

In the first preferred embodiment, in order to adjust the attenuation-pole frequency, the positions of the coupling portions 5*a* and 6*a* are fixed and the positions of the input/output portions 5*b* and 6*b* are changed. In the second preferred embodiment, the input/output coupling circuits 15 and 16 defined by inductance coils are directly coupled to the sidelines 3*b* and 3*c* of the metal film 3, and the positions of the coupling points are changed to adjust the attenuation-pole frequency.

However, the present invention is not restricted to the first and second preferred embodiments and can variously be modified according to the structure and coupling manner of the input/output coupling circuits.

Figure 10A:
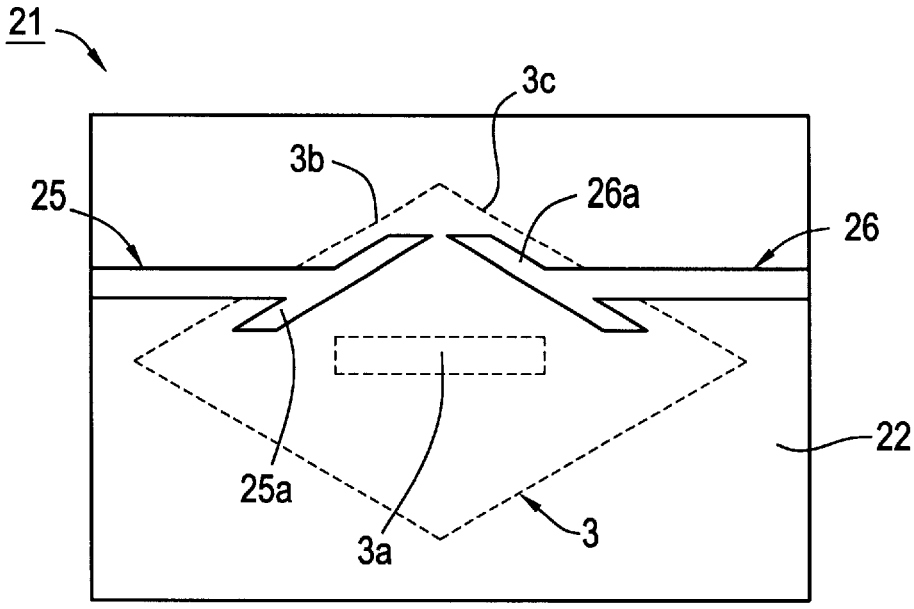
FIGS. 10A and 10B show a schematic plan view and a partially cut-away front sectional view for illustrating a method for adjusting the frequency of an attenuation pole of a dual-mode band pass filter according to a third preferred embodiment of the present invention.
Figure 10B:
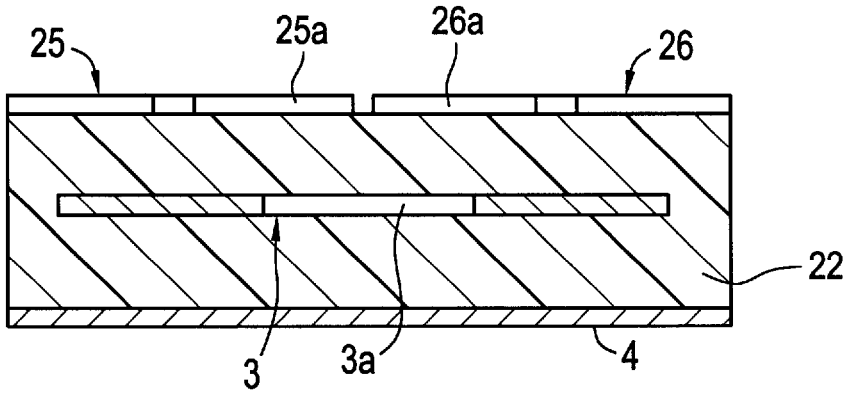

FIGS. 10A and 10B are a schematic plan view and a partially cut-away front sectional view for illustrating a method for adjusting the frequency of an attenuation pole of a dual-mode band pass filter according to a third preferred embodiment of the present invention.

In a dual-mode band pass filter 21, a metal film 3 is embedded in a dielectric substrate 22. On an upper surface 22*a* of the dielectric substrate 22, input/output coupling circuits 25 and 26 are provided. Coupling portions 25*a* and 26*a* of the input/output coupling circuits 25 and 26 are arranged in such a manner that the portions 25*a* and 26*a* overlap with the metal film 3 via a dielectric substrate layer. In other words, in the first preferred embodiment, the input/output coupling circuits are flush with the metal film 3 and the coupling portions 5*a* and 6*a* are capacitively coupled to the metal film 3. However, as shown in FIGS. 10A and 10B, the input/output coupling circuits 25 and 26 may be located at positions that are different from that of the metal film 3. In this case, the dielectric substrate 22 has a multi-layer structure that is formed by stacking a plurality of dielectric layers, and the coupling portions 25*a* and 26*a* are capacitively coupled to the metal film 3 via the dielectric-substrate layer.

In the third preferred embodiment of the present invention, by changing the coupling points of the input/output coupling circuits 25 and 26 and the metal film 3, as shown in the case of the first preferred embodiment, the attenuation-pole frequency can be changed.

In the first preferred embodiment, the coupling portions 5*a* and 6*a* are fixed and the positions of the input/output portions 5*b* and 6*b* are deviated. Alternatively, by moving the positions of the coupling portions 5*a* and 6*a* along the sidelines 3*b* and 3*c*, the frequency of the attenuation pole can be adjusted. In addition, both of the above two ways of adjusting may be used together. Similarly, in the third preferred embodiment, the frequency of the attenuation pole can be adjusted by changing the positions of the coupling portions 25*a* and 26*a* of the input/output coupling circuits 25 and 26 and/or by deviating positions at which the input/output portions 25*b* and 26*b* are coupled to the coupling portions 25*a* and 26*a*.

Furthermore, as shown in the third preferred embodiment, in a dual-mode band pass filter capable of using the method of the present invention, the metal film may be embedded in the dielectric substrate. In addition, regarding the input/output coupling circuits, it is not necessary to form the circuits on the upper surface of the dielectric substrate. The input/output coupling circuits may be formed in the dielectric substrate. Additionally, it is not necessary to form the ground electrode 4, as shown in the first preferred embodiment, on the lower surface of the dielectric substrate. The ground electrode 4 may be formed in the dielectric substrate.

Figure 11A:
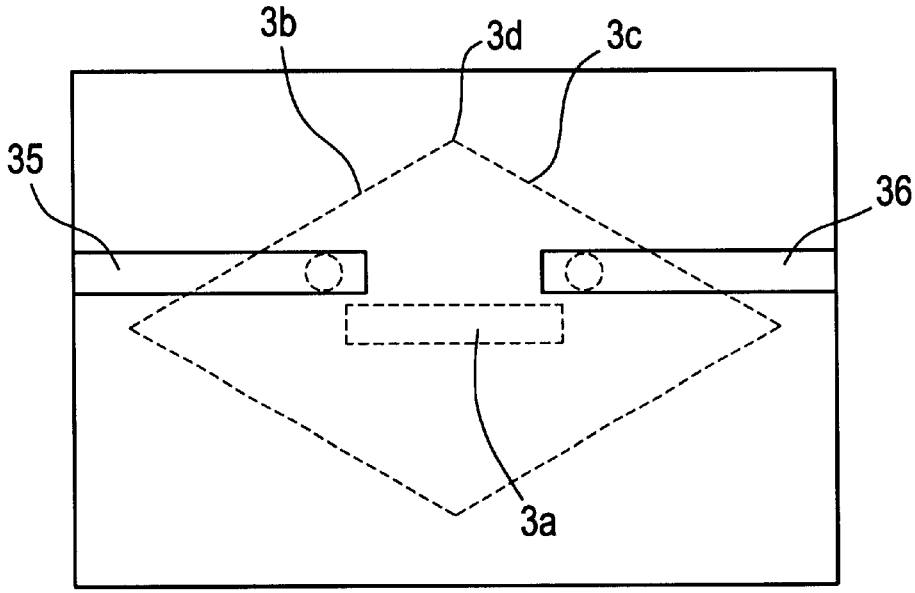
FIGS. 11A and 11B show a schematic plan view and a partially cut-away front sectional view for illustrating a method for adjusting the frequency of an attenuation pole of a dual-mode band pass filter according to a fourth preferred embodiment of the present invention.
Figure 11B:
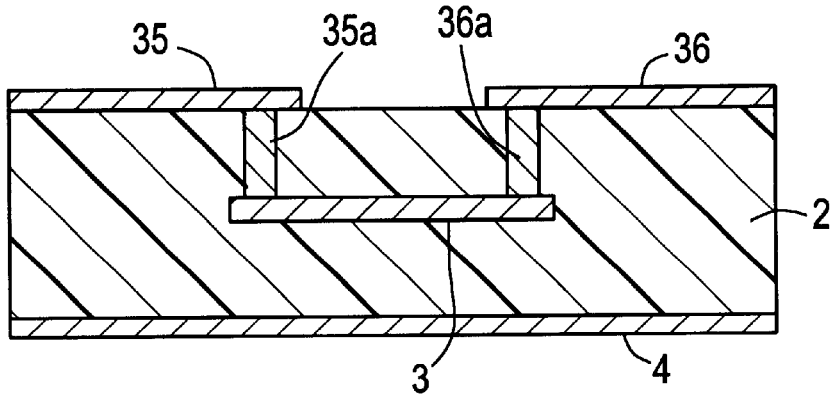
Figure 12:
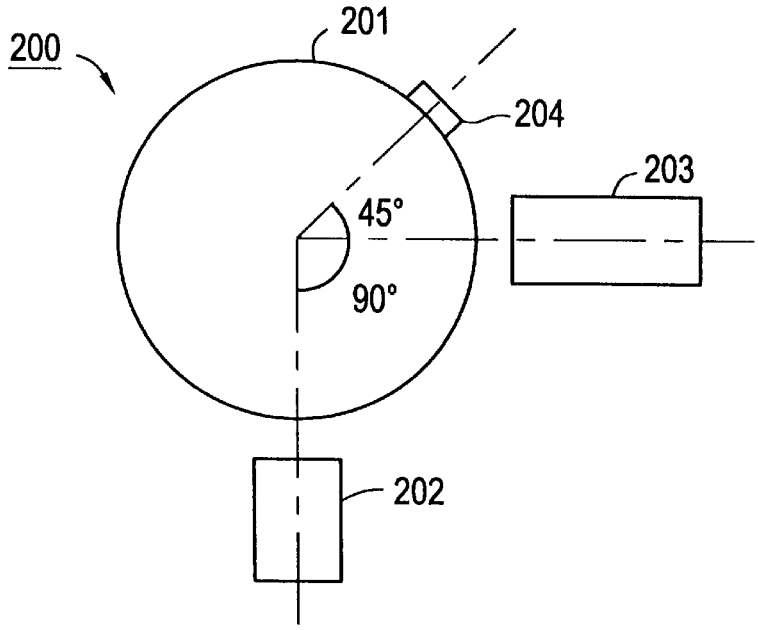
FIG. 12 PRIOR ART
FIG. 12 is a schematic plan view for illustrating a conventional dual-mode band pass filter.
Figure 13:
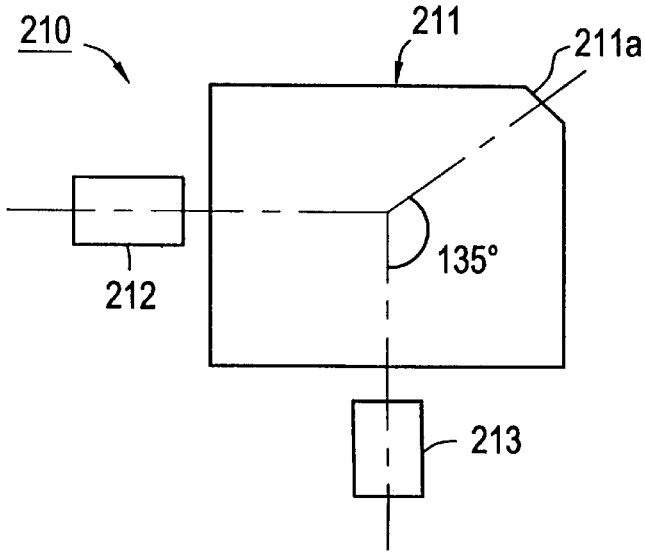
FIG. 13 PRIOR ART
FIG. 13 is a schematic plan view for illustrating another conventional dual-mode band pass filter.

FIGS. 11A and 11B are a schematic plan view and a partially cut-away front sectional view for illustrating a method for adjusting the frequency of an attenuation pole according to a fourth preferred embodiment of the present invention.

In this preferred embodiment, a metal film 3 is embedded in a dielectric substrate 2, and input/output coupling circuits 35 and 36 defined by inductance coils are disposed on the dielectric substrate 2. The input/output coupling circuits 35 and 36 are directly and electrically connected to the metal film 3 via the via-hole electrodes 35*a* and 36*a*.

In other words, in the second preferred embodiment, the strip lines 15 and 16 as the input/output coupling circuits are connected to the metal film 3 such that the strip lines 15 and 16 are flush with the metal film 3. However, as shown in the fourth preferred embodiment of the present invention, the input/output coupling circuits 35 and 36 may be positioned at a height that is different from the height at which the metal film 3 is positioned. In the fourth preferred embodiment of the present invention, as in the case of the second preferred embodiment, the frequency of the attenuation pole can be changed by changing the positions of the via-hole electrodes 35*a* and 36*a*, that is, by changing the positions of points at which the input/output coupling circuits 35 and 36 are coupled to the metal film 3. In addition, the input/output coupling circuits may be embedded in the substrate.

In each of the first to fourth preferred embodiments, the metal film 3 preferably has a rhombic shape. However, the planar shape of the metal film 3 used in the present invention is not restricted to a rhombus, and any of other polygons such as a square, a rectangular, and a triangle, or any shape having a random perimeter may be arbitrarily used.

As described above, according to the first to fourth preferred embodiments of the present invention, the metal film for forming a resonator is disposed on the dielectric substrate, and at least one opening is formed in the metal film to couple two resonance modes. Thus, the positions of the points at which the input/output coupling circuits are coupled to the metal film are not specifically restricted. As a result, by coupling the two resonance modes, band characteristics required as a dual-mode band pass filter can be obtained.

In the first preferred embodiment of the present invention, the input/output coupling circuits include the coupling portions, which are capacitively coupled to the metal film, and the input/output portions. Since at least either the coupling portions or the input/output portions are moved in a direction along the perimeter of the metal film facing via the gap, the frequency of the attenuation pole can be easily adjusted.

In the method according to the second preferred embodiment of the invention, the input/output coupling circuits are preferably defined by inductors. One end of each of the input/output coupling circuits is directly and electrically connected to the metal film, and the points at which the input/output coupling circuits are coupled to the metal film are moved along the perimeter of the metal film. With this arrangement, the frequency of the attenuation pole of the dual-mode band pass filter can be easily adjusted.

In the third preferred embodiment of the present invention, a dielectric multilayer structure between the metal film and the input/output coupling circuits. The input/output coupling circuits overlap with the metal film via the dielectric multilayer structure to be capacitively coupled to the metal film. In this arrangement, the frequency of an attenuation pole of the dual-mode band pass filter can easily be adjusted by moving the positions of the input/output coupling circuits along the perimeter of the metal film on the dielectric multilayer structure.

In the fourth preferred embodiment of the present invention, the insulating layer having via-hole electrodes is disposed between the input/output coupling circuits and the metal film. First side ends of the via-hole electrodes are electrically connected to the input/output coupling circuits, and the other ends thereof are electrically connected to the metal film. Thus, the frequency of the attenuation pole of the dual-mode band pass filter can easily be adjusted by moving the positions connecting the via-hole electrodes to the input/output coupling circuits and the metal film.

In the conventional dual-mode band pass filter, there are limitations to the shape of the metal film forming a resonator and the positions of the points at which the input/output coupling circuits are coupled to the metal film. However, there are no such limitations to the dual-mode band pass filter according to each of the first to fourth preferred embodiments of the invention. Thus, the freedom of designing the dual-mode band pass filter is greatly increased. Moreover, the frequency of the attenuation pole can be easily adjusted not only by changing the dimensions of the metal film and the opening but also by changing the positions of the points coupling the input/output coupling circuits to the metal film, as shown in various preferred embodiments of the present invention.

While the invention has been described with reference to preferred embodiments, it will be obvious to those skilled in the art that modifications and variations may be made without departing from the scope and spirit of the invention.

However, the present invention is not restricted to the first and second preferred embodiments and can variously be modified according to the structure and coupling manner of the input/output coupling circuits.

FIGS. 10A and 10B are a schematic plan view and a partially cut-away front sectional view for illustrating a method for adjusting the frequency of an attenuation pole of a dual-mode band pass filter according to a third preferred embodiment of the present invention.

In a dual-mode band pass filter 21, a metal film 3 is embedded in a dielectric substrate 22. On an upper surface 22*a* of the dielectric substrate 22, input/output coupling circuits 25 and 26 are provided. Coupling portions 25*a* and 26*a* of the input/output coupling circuits 25 and 26 are arranged in such a manner that the portions 25*a* and 26*a* overlap with the metal film 3 via a dielectric substrate layer. In other words, in the first preferred embodiment, the input/output coupling circuits are flush with the metal film 3 and the coupling portions 5*a* and 6*a* are capacitively coupled to the metal film 3. However, as shown in FIGS. 10A and 10B, the input/output coupling circuits 25 and 26 may be located at positions that are different from that of the metal film 3. In this case, the dielectric substrate 22 has a multilayer structure that is formed by stacking a plurality of dielectric layers, and the coupling portions 25*a* and 26*a* are capacitively coupled to the metal film 3 via the dielectric-substrate layer.

In the third preferred embodiment of the present invention, by changing the coupling points of the input/output coupling circuits 25 and 26 and the metal film 3, as shown in the case of the first preferred embodiment, the attenuation-pole frequency can be changed.

In the first preferred embodiment, the coupling portions 5*a* and 6*a* are fixed and the positions of the input/output portions 5*b* and 6*b* are deviated. Alternatively, by moving the positions of the coupling portions 5*a* and 6*a* along the sidelines 3*b* and 3*c*, the frequency of the attenuation pole can be adjusted. In addition, both of the above two ways of adjusting may be used together. Similarly, in the third preferred embodiment, the frequency of the attenuation pole can be adjusted by changing the positions of the coupling portions 25*a* and 26*a* of the input/output coupling circuits 25 and 26 and/or by deviating positions at which the input/output portions 25*b* and 26*b* are coupled to the coupling portions 25*a* and 26*a*.

Furthermore, as shown in the third preferred embodiment, in a dual-mode band pass filter capable of using the method of the present invention, the metal film may be embedded in the dielectric substrate. In addition, regarding the input/output coupling circuits, it is not necessary to form the circuits on the upper surface of the dielectric substrate. The input/output coupling circuits may be formed in the dielectric substrate. Additionally, it is not necessary to form the ground electrode 4, as shown in the first preferred embodiment, on the lower surface of the dielectric substrate. The ground electrode 4 may be formed in the dielectric substrate.

FIGS. 11A and 11B are a schematic plan view and a partially cut-away front sectional view for illustrating a method for adjusting the frequency of an attenuation pole according to a fourth preferred embodiment of the present invention.

In this preferred embodiment, a metal film 3 is embedded in a dielectric substrate 2, and input/output coupling circuits 35 and 36 defined by inductance coils are disposed on the dielectric substrate 2. The input/output coupling circuits 35 and 36 are directly and electrically connected to the metal film 3 via the via-hole electrodes 35*a* and 36*a*.

In other words, in the second preferred embodiment, the strip lines 15 and 16 as the input/output coupling circuits are connected to the metal film 3 such that the strip lines 15 and 16 are flush with the metal film 3. However, as shown in the fourth preferred embodiment of the present invention, the input/output coupling circuits 35 and 36 may be positioned at a height that is different from the height at which the metal film 3 is positioned. In the fourth preferred embodiment of the present invention, as in the case of the second preferred embodiment, the frequency of the attenuation pole can be changed by changing the positions of the via-hole electrodes 35*a* and 36*a*, that is, by changing the positions of points at which the input/output coupling circuits 35 and 36 are coupled to the metal film 3. In addition, the input/output coupling circuits may be embedded in the substrate.

In each of the first to fourth preferred embodiments,

As described above, according to the first to fourth preferred embodiments of the present invention, the metal film for forming a resonator is disposed on the dielectric substrate, and at least one opening is formed in the metal film to couple two resonance modes. Thus, the positions of the points at which the input/output coupling circuits are coupled to the metal film are not specifically restricted. As a result, by coupling the two resonance modes, band characteristics required as a dual-mode band pass filter can be obtained.

In the first preferred embodiment of the present invention, the input/output coupling circuits include the coupling portions, which are capacitively coupled to the metal film, and the input/output portions. Since at least either the coupling portions or the input/output portions are moved in a direction along the perimeter of the metal film facing via the gap, the frequency of the attenuation pole can be easily adjusted.

In the method according to the second preferred embodiment of the invention, the input/output coupling circuits are preferably defined by inductors. One end of each of the input/output coupling circuits is directly and electrically connected to the metal film, and the points at which the input/output coupling circuits are coupled to the metal film are moved along the perimeter of the metal film. With this arrangement, the frequency of the attenuation pole of the dual-mode band pass filter can be easily adjusted.

In the third preferred embodiment of the present invention, a dielectric multilayer structure between the metal film and the input/output coupling circuits. The input/output coupling circuits overlap with the metal film via the dielectric multilayer structure to be capacitively coupled to the metal film. In this arrangement, the frequency of an attenuation pole of the dual-mode band pass filter can easily be adjusted by moving the positions of the input/output coupling circuits along the perimeter of the metal film on the dielectric multilayer structure.

In the fourth preferred embodiment of the present invention, the insulating layer having via-hole electrodes is disposed between the input/output coupling circuits and the metal film. First side ends of the via-hole electrodes are electrically connected to the input/output coupling circuits, and the other ends thereof are electrically connected to the metal film. Thus, the frequency of the attenuation pole of the dual-mode band pass filter can easily be adjusted by moving the positions connecting the via-hole electrodes to the input/output coupling circuits and the metal film.

What is claimed is:

1. A method of designing a dual-mode band pass filter comprising a dielectric substrate, a metal film having an opening disposed on the surface of the dielectric substrate or within the dielectric substrate, a ground electrode overlapping with the metal film via a portion of the dielectric substrate in a thickness direction of the dielectric substrate, and a pair of input-output coupling circuits coupled to the metal film, the method comprising the steps of:

selecting dimensions of the metal film and the opening so as to obtain a desired central frequency and a desired bandwidth of the dual-mode band pass filter by coupling two resonance modes which are generated in the metal film; and selecting locations of the input-outout coupling circuits along the perimeter of the metal film so as to obtain a desired frequency of an attenuation pole of the dual-mode band pass filter.

2. The method according to claim 1, wherein the dielectric substrate has a substantially rectangular plate configuration.

3. The method according to claim 1, wherein the metal film has one of a rhombic shape, a square shape, a rectangular shape, and a triangle shape.

4. The method according to claim 1, wherein the opening is formed in such a manner that the center of the opening coincides with the center of the metal film.

5. The method according to claim 1, wherein the input/output coupling circuits include a coupling portion and an input/output portion and the step of selecting locations of the input-output coupling circuits includes the steps of selecting locations of both of the coupling portion and the input/output portion along the perimeter of the metal film so as to obtain the desired frequency of the attenuation pole.

6. The method according to claim 1, wherein the input-output coupling portions are capacitively coupled to the metal film via a gap.

7. The method according to claim 1, wherein the input-output coupling portions are directly and electrically coupled to the metal film via at least one of a strip line and a microstrip line.

8. The method according to claim 1, wherein the metal film and the input-output coupling circuit are formed on different layers of the dielectric substrate;

and the input-output coupling portions are capacitively coupled to the metal film via at least one of the dielectric layers.

9. The method according to claim 1, wherein the metal film and the input-output coupling circuit are formed on different layers of the dielectric substrate, and the input-output coupling portions are directly and electrically coupled to the metal film via via-hole electrodes formed in at least one of the dielectric layers.

* * * * *